US005806688A

United States Patent [19]

Adenau et al.

[11] Patent Number: 5,806,688

[45] Date of Patent: Sep. 15, 1998

[54] ARTICLE DISPLAY CENTER

[75] Inventors: Marvin Adenau, Wadsworth, Ill.; Larry Hunn, Dunwoody, Ga.; William Brice, Jr., Palatine, Ill.

[73] Assignee: Schultz International, Inc., Morton Grove, Ill.

[21] Appl. No.: 718,993

[22] Filed: Sep. 24, 1996

[51] Int. Cl.[6] ..... A47F 7/00

[52] U.S. Cl. ..... 211/47

[58] Field of Search ..... 211/45, 150, 168, 211/169, 169.1

[56] References Cited

U.S. PATENT DOCUMENTS

| | | | |
|---|---|---|---|
| 858,472 | 7/1907 | Rost | 211/47 |
| 3,235,093 | 2/1966 | Eisbart et al. . | |
| 3,570,679 | 3/1971 | Edson . | |
| 5,553,724 | 9/1996 | Moher et al. . | |

*Primary Examiner*—Alvin C. Chin-Shue
*Assistant Examiner*—Sarah Purol
*Attorney, Agent, or Firm*—Wood, Phillips, VanSanten, Clark & Mortimer

[57] ABSTRACT

A display system including a frame defining a storage area for samples of an article to be displayed, a first structure for holding an article in a display position, and an element cooperating between the first structure and frame for allowing selective repositioning of the first structure relative to the frame between (A) a first position wherein (a) at least one of the first structure and an article in the display position on the first structure substantially blocks the storage area from view from a front display viewing vantage point and (b) an article in the display position on the first structure is viewable from the front display viewing vantage point and (B) a second position wherein the storage area is at least partially exposed so that samples in the storage area are accessible from the front of the display system. The storage area includes a plurality of vertically spaced shelves each defining a storage receptacle for articles. The first means includes a plurality of support members, each repositionable between first and second positions with one support member associated with each shelf. Each of the shelves includes a plurality of regularly spaced vertical members dividing each of the storage receptacles into a plurality of sub-receptacles, and each of the support members includes a plurality of cup-shaped receptacles formed in a front surface thereof with one cup-shaped receptacle on a support member associated with each sub-receptacle on a shelf.

24 Claims, 4 Drawing Sheets

ARTICLE DISPLAY CENTER

FIELD OF THE INVENTION

The present invention relates to a system for displaying samples of an article and, particularly, to a system for displaying a plurality of different color/texture carpet samples.

BACKGROUND OF THE INVENTION

Shopping for carpet is often considered a stressful and frustrating task. The present methods of displaying carpet for sale make it difficult for consumers to quickly select a desirable color and style of carpet within their respective price range.

Generally, retail carpet stores use basket racks to display samples of different color/texture carpet. These basket racks are often difficult to use, may take up valuable space and may impede consumer maneuverability between racks. The carpet samples held in the racks are often relatively large, thus making it both difficult and tiresome to flip through the different color/texture carpet samples when shopping for carpet.

Further, a carpet retailer wishing to display 120 different colors of carpet will typically need approximately 25 basket racks and about 450 square feet of display space. This is space that could be better used for inventory purposes.

As a result, when shopping for carpet, a consumer may be required to tediously maneuver between rack after rack, flipping through carpet sample after carpet sample, in order to select an appropriate color/texture carpet. This can be both mentally and physically draining. If the consumer chooses a color or two and wishes to take home a swatch of a carpet, he/she must locate an employee and request that the employee cut a small piece of carpet from the appropriate color carpet which is in inventory. If the store happens not to have that particular color carpet in inventory, then no swatch can be made available to the consumer.

As a result of the consumer frustration often associated with shopping for carpet, many consumers simply put off buying carpet until absolutely necessary and, as a result, the retail store(s) lose potential sales.

Aside from consumer frustration in buying carpet, there is also retailer frustration in selling carpet. Each season colors and/or styles of carpet change. This requires carpet retailers to keep abreast of the recent trends, and update their showroom whenever necessary. The samples held by the basket racks are generally cut from carpet in inventory. Therefore, in order to display a new color or style of carpet, the retailer must generally purchase the carpet for inventory. Thus, a typical carpet retailer can spend as much as $2,000 in redoing a showroom each season.

SUMMARY OF THE INVENTION

The present invention is specifically directed to overcoming one or more of the above-enumerated problems in a novel and simple manner.

The present invention is directed toward a display system having a frame defining a storage area for samples of an article to be displayed, a first structure for holding an article in a display position, and an element cooperating between the first structure and frame for allowing selective repositioning of the first structure relative to the frame between (A) a first position wherein (a) at least one of the first structure and an article in the display position on the first structure substantially blocks the storage area from view from a front display viewing vantage point and (b) an article in the display position on the first structure is viewable from the front display viewing vantage point and (B) a second position wherein the storage area is at least partially exposed so that samples in the storage area are accessible from the front of the display system.

In one form, the first structure may include a support member having a front surface and top and bottom edges, with the article in the display position attached to the front surface of the support member.

In one form, the storage area may include a plurality of vertically spaced shelves each defining at least one storage receptacle for articles, and the first structure may include a plurality of support members with one support member associated with each shelf.

In one form, each of the support members may have a front surface and top and bottom edges and may be pivotable about its top edge between first and second positions. The bottom edge of one support member in the first position may overlap the top edge of an adjacent lower support member in the first position to thereby fully block access to the shelf associated with the one support member.

A plurality of different color/texture carpet swatches may be provided, each in a display position on one of the support members, with at least one removable carpet swatch sample having a first color/texture in one storage receptacle defined by one of the shelves and a carpet swatch sample having the first color/texture in a display position on the support member associated with the one shelf, and at least one removable carpet swatch sample having a second color/texture in another storage receptacle defined by another of the shelves and a carpet swatch sample having the second color/texture in a display position on the support member associated with the another shelf, whereby the user can pivot a selected support member to the second position and remove a carpet swatch of a selected color/texture from the storage receptacle defined by the shelf associated with the selected support member.

In one form, each of the shelves includes a plurality of regularly spaced vertical members dividing each of the storage receptacles into a plurality of sub-receptacles, and there is at least one removable carpet swatch sample having a first color/texture in one of the sub-receptacles on a first shelf and a carpet swatch sample having the first color/texture in a display position associated with the one sub-receptacle on the support member associated with the first shelf, and at least one removable carpet swatch sample having a second color/texture in another of the sub-receptacles on the first shelf and a carpet swatch sample having a second color/texture in a display position associated with the another sub-receptacle on the support member associated with the first shelf, whereby a user can pivot the support member associated with the first shelf to the second position and remove a carpet swatch of either the first or second color/texture from the first shelf.

The display carpet swatches may be adhesively attached to the front surfaces of the support members.

The display carpet swatches may be disposed in cup-shaped receptacles formed in the front surfaces of the support members.

In one form, the display system is in combination with a kiosk having a plurality of different texture/color carpet samples and a source of information and ideas on carpet selection related to the carpet samples displayed and stored in the display system.

Other aspects, objects and advantages of the present invention can be obtained from a study of the specification, the drawings, and the appended claims.

DETAILED DESCRIPTION OF THE PREFERRED EMBODIMENT

Figure 1:
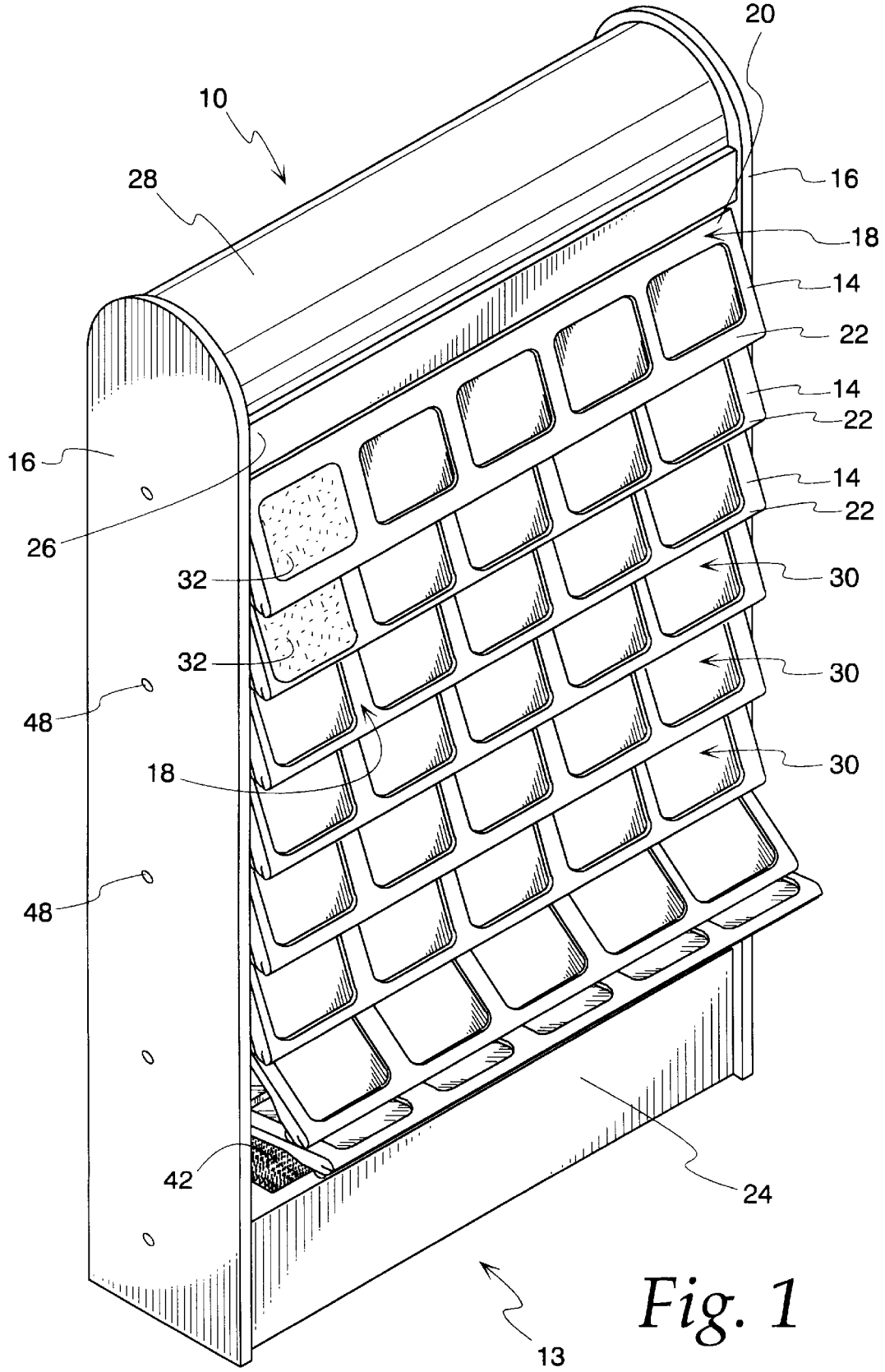
FIG. 1 is a perspective view of one carpet selection module in accordance with the present invention.

FIG. 1 shows a carpet display module 10 that is part of a composite display system 12 (see FIG. 4) of the present invention. Generally, the display module 10 consists of a frame 13 and a plurality of vertically spaced support members 14 pivotably mounted to the frame 13.

More specifically, the vertically spaced support members 14 are each pivotably mounted between side panels 16. The support members 14 each include a front surface, shown generally at 18, and top and bottom edges 20,22. As more easily seen from FIG. 3, the support members 14 are pivotably mounted between the side panels 16 at their top edge 20. In one form, as shown in FIG. 1, eight support members 14 are included. It is to be understood, however, that the invention contemplates more or less support members 14, depending on the particular requirements.

A bottom panel 24 is attached between the side panels 16 below the bottommost support member 14, and a top panel 26 is attached between the side panels 16 above the topmost support member 14. A curved top 28 is provided which conforms generally with the curved top of the side panels 16. The top 28 may be made of a semi-transparent or translucent material and backlit for aesthetic purposes.

A plurality of cup-shaped receptacles 30 are formed in the front surfaces 18 of each of the support members 14. A corresponding plurality of carpet swatch samples 32 are disposed in a display position on the front surface 18 of the support members 14, preferably in the cup-shaped receptacles 30. The carpet swatch samples 32 may be adhesively attached or held in place by a frictional force associated with the sidewalls of the cup-shaped receptacles 30.

In the embodiment shown, five cup-shaped receptacles 30 are formed in the front surface 18 of each support member 14, spaced at predetermined, regular intervals. The carpet display module 10 is capable of displaying forty (5×8) different colors/textures of carpet. In one form, the carpet swatch samples 32 displayed on the front surfaces 18 of the support members 14 are 9"×9" carpet swatches. However, it is to be understood that other display capacities and carpet swatch dimensions are contemplated by the present invention.

Figure 2:
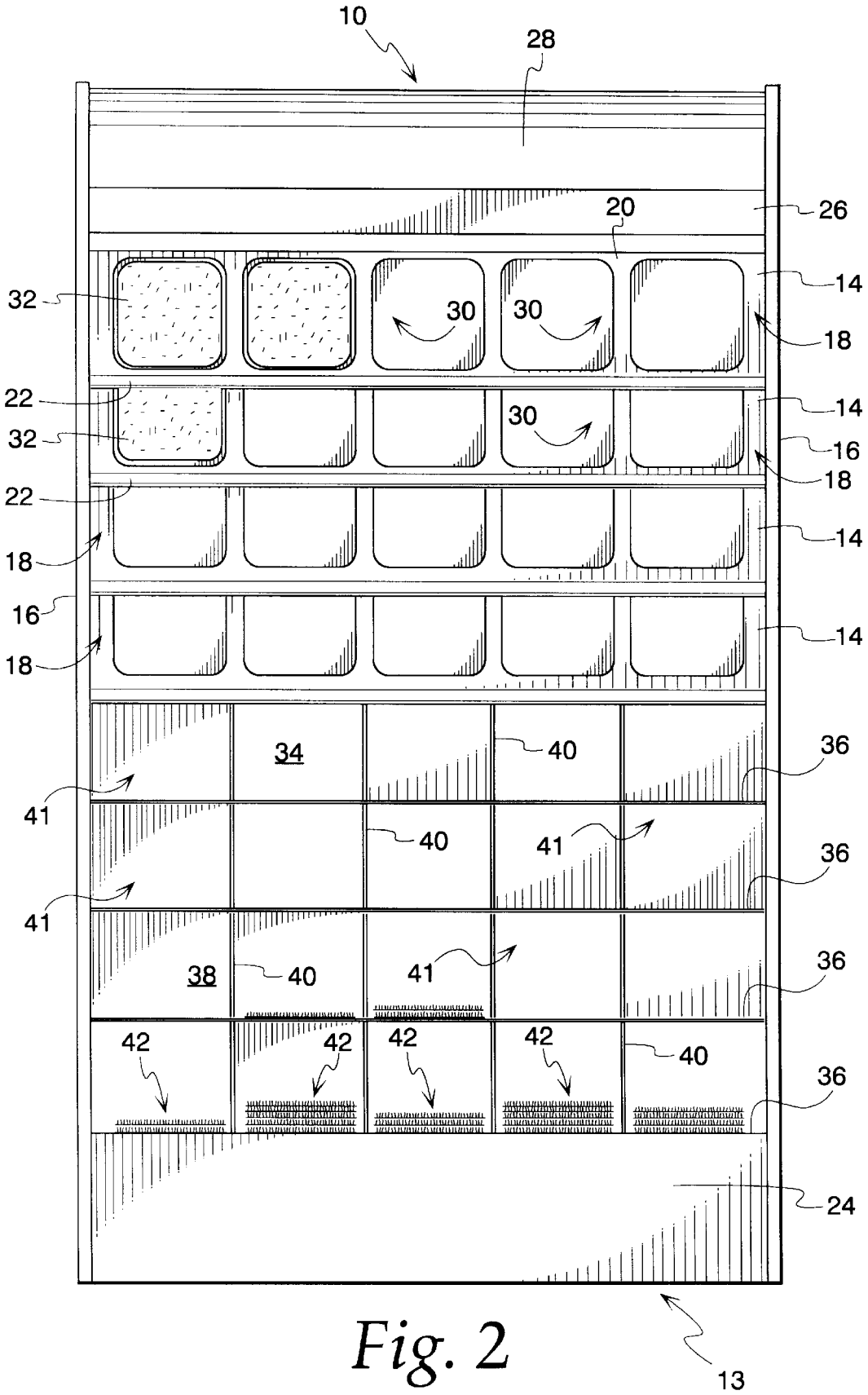
FIG. 2 is a front elevation view of the carpet selection module shown in FIG. 1.

Referring now to FIG. 2, a storage area, defined by the frame 13 and shown generally at 34, is provided behind the support members 14. The storage area 34 includes a plurality of vertically spaced shelves 36, each defining at least one storage receptacle 38, with one shelf 36 associated with each support member 14. A plurality of vertical members 40 are provided on each shelf 36 dividing the storage receptacles 38 defined by the shelves 36 into a plurality of sub-receptacles 41.

Removable carpet swatches 42 are disposed in the sub-receptacles 41. The removable carpet swatches 42 are generally 4½×9" carpet swatches, however, other dimensions may be used. Preferably, the number of sub-receptacles 41 on a shelf 36 equals the number of cup-shaped receptacles 30 formed in the front surface 18 of a support member 14 associated with that particular shelf 36. In one form, there are five sub-receptacles 41 on each shelf 36 corresponding to the five cup-shaped receptacles 30 formed in the front surface 18 of each support member 14, with the sub-receptacles 41 located behind the corresponding cup-shaped receptacles 30. However, other quantities of sub-receptacles cup-shaped receptacles 30 can be implemented with the present invention without departing from the spirit and scope thereof.

The support members 14 are pivotable about their top edge 20 between first and second positions. The top four support members 14 depicted in FIG. 2 are shown in the first position. As seen in FIG. 2, in this first position: (a) the support members 14 and/or the carpet samples 32 displayed on the front surfaces 18 thereof substantially block the associated sub-receptacles 41 and the removable carpet swatches 42 stored therein from view when the carpet display module 10 is viewed from a front display viewing vantage point, and (b) the carpet samples 32 displayed on the front surfaces 18 of the support members 14 are viewable from the front display viewing vantage point.

Figure 3:
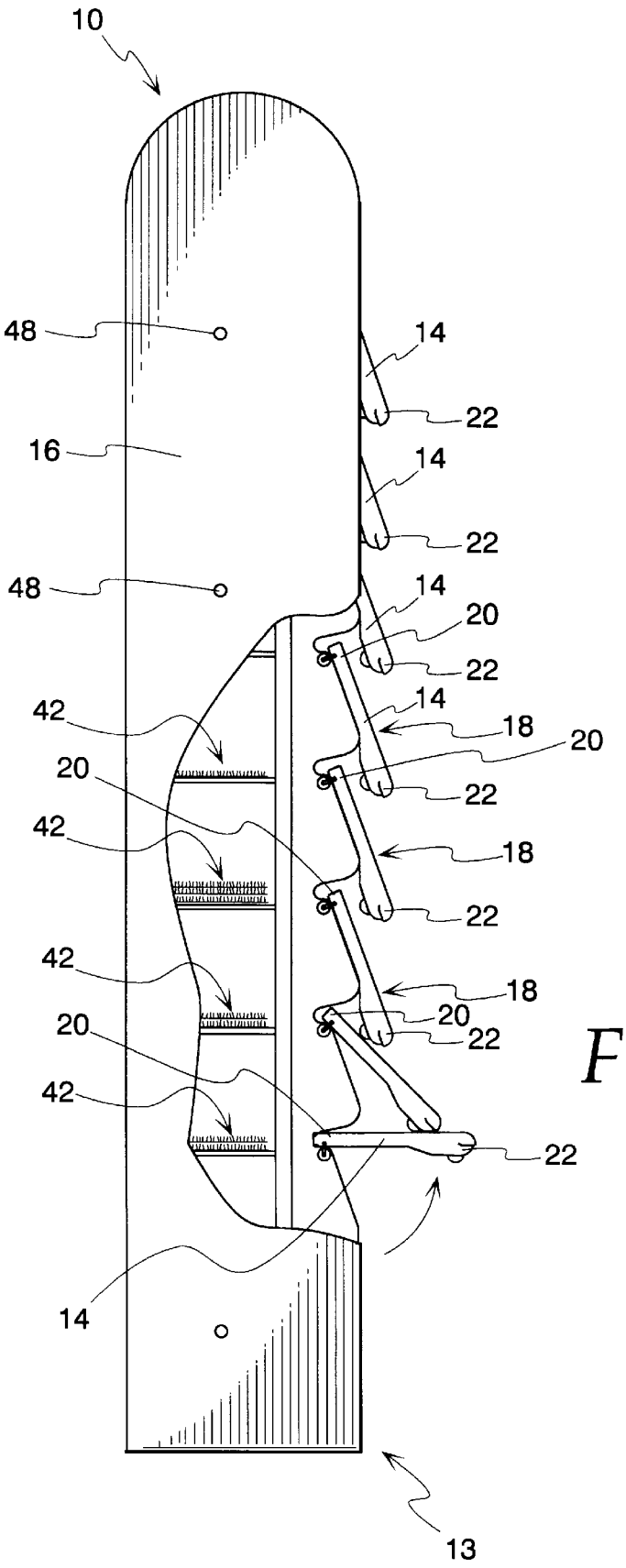
FIG. 3 is a side elevation view of the carpet selection module shown in FIG. 1 with a portion of the side cutout.

As seen from FIG. 3, with the support members 14 in the first position, the bottom edge 22 of one support member 14 in the first position overlaps the top edge 20 of an adjacent lower support member 14 in the first position to aid in concealing the sub-receptacles 41/removable carpet swatches 42 from view while maintaining visibility of the carpet samples 32 displayed on the front surfaces 18 of the support members 14 from the front display viewing vantage point.

The bottommost support member 14 in FIG. 3 is shown pivoted to the second position. In this position, the support member 14 is substantially horizontal and access to the sub-receptacles 41 located behind the bottommost support member 14 is gained, and the removable carpet swatches 42 stored therein can be removed by a user.

Figure 4:
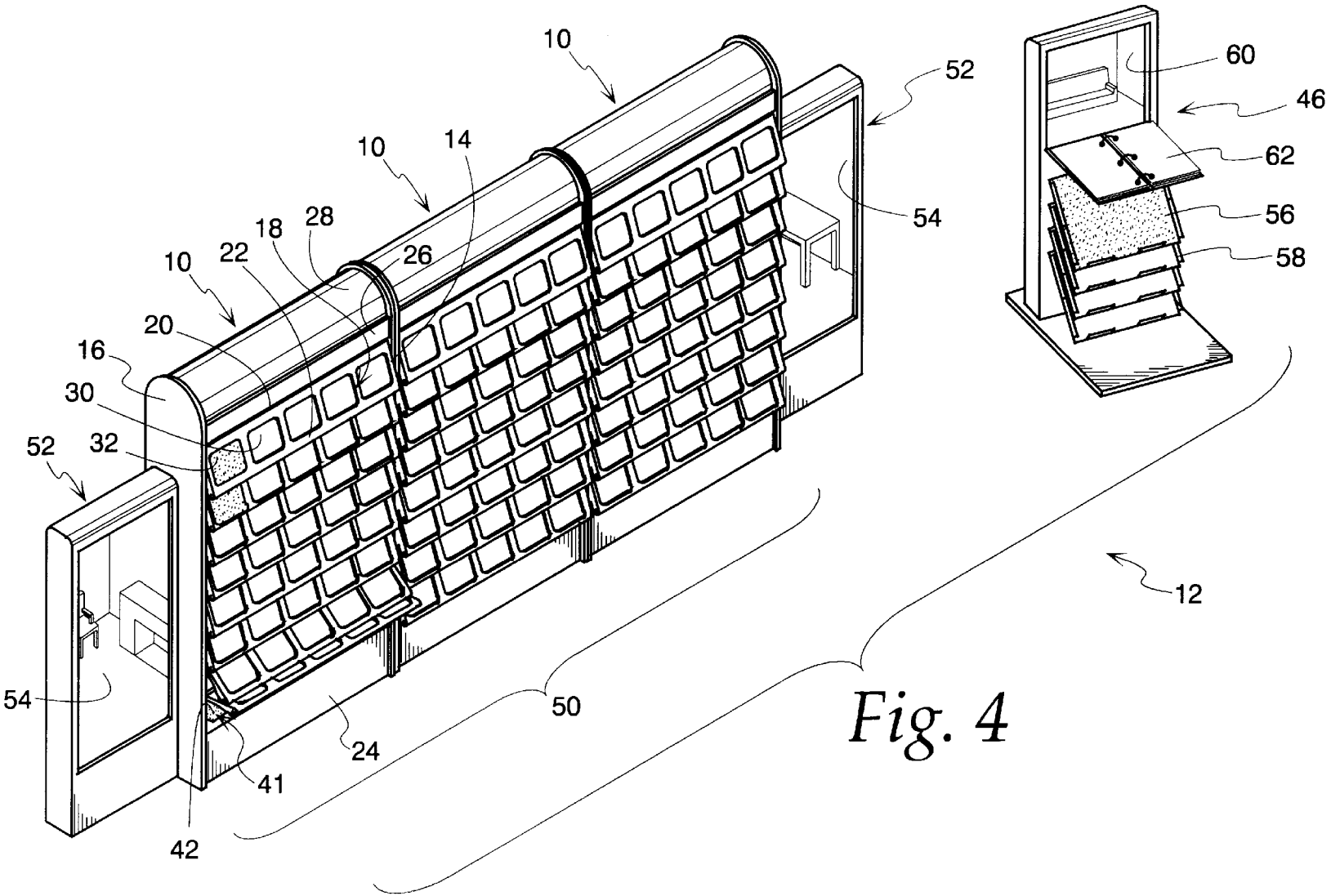
FIG. 4 is a perspective view of a composite carpet display system in accordance with the present invention.

The carpet display module 10 may form part of a composite carpet display system 12, as shown in FIG. 4. The composite carpet display system 12 consists of a plurality of display modules 10 operably connected and a free-standing kiosk 46. Each of the carpet display modules 10 includes a plurality of holes 48 (see FIG. 1) in the side panels 16 spaced at predetermined intervals. The holes 48 on adjacent display modules 10 are aligned and the display modules 10 are operably connected via conventional press connecting means (not shown). The operably connected display modules 10 and, more particularly, the support members 14 and carpet samples 32 displayed on the front surfaces 18 thereof, generally define a color wall 50.

In the embodiment shown in FIG. 4, the composite carpet display system 12 includes three display modules 10, with each display module 10 having eight support members 14, with each support member 14 having five cup-shaped receptacles 30 formed in the front surface 18 thereof. Accordingly, the composite display system 12 shown in FIG. 4 is capable of displaying one-hundred twenty different colors/textures of carpet. However, it is to be understood that other capacities are contemplated.

The composite carpet display system 12 includes room scene displays 52 on either side of the operably connected display modules 10. The displays 52 may include a translucent room setting photo 54 backlit by a light source (not shown). Preferably, the displays 52 include a plurality of holes aligned with the holes 48 in the sides 16 of the display modules 10 and are connected thereto via conventional press connecting means (not shown).

The kiosk 46 includes samples of different styles of carpet 56. In one form, the kiosk includes samples of six different styles of carpets 56. However, any number of different styles of carpet may be displayed on the kiosk 46. The carpet style samples 56 are generally 27"×18" carpet samples and are provided in wire rack baskets 58. However, other sample dimensions and means of displaying the carpet style samples 56 on the kiosk 46 may be implemented without departing from the spirit and scope of the present invention.

In one form, the six different styles of carpet 56 include four textures and two saxsons. The kiosk 46 also may include a room setting photo 60 and a source of information and ideas 62 for each consumer. The room setting photo 60 may be translucent and backlit by a light source (not shown).

The composite carpet display system 12 permits a potential consumer to readily select a desired color of carpet from the displayed carpet samples 32 which form part of the color wall 50. The consumer can then readily move to the kiosk 46 and identify a style of carpet from the samples 56 that falls within a particular price range that meets his/her needs. The consumer can then move back to the color wall 50, pivot a support member 14 to the second position (see the bottommost support member 14 of the leftmost display module 10 in FIG. 4) and remove a carpet swatch 42 from the appropriate sub-receptacle 41.

In one form, the composite display system 12 takes up less than 50 square feet of space in a retail carpet store. This is a drastic improvement over the approximately 450 square feet of space that might be necessary to display the same number of different colored carpets using basket racks.

While the above display system has been described as including samples of carpet to be displayed, those skilled in the art will recognize that other articles may be display utilizing the above described display system without departing from the spirit and scope thereof.

It should be further understood that the foregoing description was made for the purposes of demonstrating the basic operation of the present invention, and no unnecessary limitations are to be understood therefrom.

We claim:

1. A display system comprising:

a frame having a front and rear and defining a storage area for at least one article of a type to be displayed through the display system which storage area comprises at least one receptacle in which the at least one article can be stored; and a support member for holding an article in a display position and mounted in front of the one receptacle for movement relative to the frame between first and second positions, wherein with the support member in the first position, at least one of the support member and an article in the display position on the support member substantially blocks the one receptacle from view from a front display viewing vantage point, wherein with the support member in the second position, the one receptacle is at least partially exposed so that an article in the one receptacle is accessible to be removed from the one receptacle wherein the support member does not extend into the one receptacle as the support member moves between the first and second positions from the front of the display system.

2. The display system of claim 1 further comprising (a) a first type of article in the display position and (b) a pluralitv of samples of the first type of article in the storage area.

3. The display system of claim 1, wherein the support member has a front surface and top and bottom edges, and wherein the article in the display position is attached to the front surface of the support member.

4. The display system of claim 3, wherein the storage area includes a plurality of vertically spaced shelves each defining a storage receptacle for articles, and wherein there are a plurality of support members, each repositionable between first and second positions with at least one support member associated with each shelf.

5. The display system of claim 4, wherein each of the support members has a front surface and top and bottom edges and is pivotable about its top edge between the first and second positions, and wherein the bottom edge of one support member in the first position overlaps the top edge of an adjacent lower support member in the first position to thereby fully block access to the storage receptacle defined by the shelf associated with the one support member.

6. The display system of claim 5, further comprising:

a plurality of article that are different color/texture carpet swatches each in a display position on one of the support members, wherein there is at least one removable carpet swatch sample having a first color/texture in one storage receptacle defined by one of the shelves and a carpet swatch sample having the first color/texture in a display position on the support member associated with the one shelf, and at least one removable carpet swatch sample having a second color/texture in another storage receptacle defined by another of the shelves and a carpet swatch sample having the second color/texture in a display position on the support member associated with the another shelf, whereby a user can pivot a selected support member to the second position and remove a carpet swatch of a selected color/texture from the storage receptacle defined by the shelf associated with the selected support member.

7. The display system of claim 5, further comprising:

a plurality of different color/texture carpet swatches each in a display position on one of the support members, wherein each of the shelves includes a plurality of regularly spaced vertical members dividing each of the storage receptacles into a plurality of sub-receptacles, and wherein there is at least one removable carpet swatch sample having a first color/texture in one of the sub-receptacles on a first shelf and a carpet swatch sample having the first color/texture in a display position associated with the one sub-receptacle on the support member associated with the first shelf, and at least one removable carpet swatch sample having a second color/texture in another of the sub-receptacles on the first shelf and a carpet swatch sample having the second color/texture in a display position associated with the another sub-receptacle on the support member associated with the first shelf, whereby a user can pivot the support member associated with the first shelf to the second position and remove a carpet swatch of either the first or second color/texture from the first shelf.

8. The display system of claim 6, further comprising a kiosk, said kiosk comprising a plurality of different texture/color carpet samples, and a source of information and ideas on carpet selection related to the carpet samples displayed and stored in the display system.

9. The display system of claim 6, wherein the display carpet swatches are adhesively attached to the front surfaces of the support members.

10. The display system of claim 6, wherein the display carpet swatches are disposed in cup-shaped receptacles formed in the front surfaces of the support members.

11. The display system of claim 1, wherein the storage area includes a plurality of vertically spaced shelves each defining at least one storage receptacle for sample carpet swatches, wherein the display system comprises a plurality of support members, each having a front surface and top and bottom edges and a carpet swatch in a display position with at least one support member associated with each shelf, wherein each of the plurality of carpet samples in the display position is attached to the front surface of one of the support members, wherein each of the support members is pivotable about its top edge between first and second positions, and wherein the bottom edge of one support member in the first position overlaps the top edge of an adjacent lower support member in the first position to thereby fully block access to the storage receptacle defined by the shelf associated with the one support member.

12. The display system of claim 11, wherein each of the shelves includes a plurality of regularly spaced vertical members dividing each of the storage receptacles into a plurality of sub-receptacles, and wherein there is at least one removable carpet swatch sample having a first color/texture in one of the sub-receptacles on one shelf and a carpet swatch sample having the first color/texture in a display position associated with the one sub-receptacle on the support member associated with the one shelf, and at least one removable carpet swatch sample having a second color/texture in another of the sub-receptacles on the one shelf and a carpet swatch sample having the second color/texture in a display position associated with the another sub-receptacle on the support member associated with the one shelf, whereby a user can pivot the support member associated with the one shelf to the second position and remove a carpet swatch of either the first or second color/texture from the one shelf.

13. The display system of claim 11, wherein there is at least one removable carpet swatch sample having a first color/texture in one storage receptacle defined by one of the shelves and a carpet swatch sample having the first color/texture in a display position on the support member associated with the one shelf, and at least one removable carpet swatch sample having a second color/texture in another storage receptacle defined by another of the shelves and a carpet swatch sample having the second color/texture in a display position on the support member associated with the another shelf, whereby a user can pivot a selected support member to the second position and remove a carpet swatch of a selected color/texture from the storage receptacle defined by the shelf associated with the selected support member.

14. A display system comprising:

(A) a first module comprising:

a first frame having a front and rearend defining a first storage area for at least one article of a type to be displayed through the display system which first storage area comprises at least one receptacle in which the at least one article can be stored; and a first support member for holding an article in a display position and mounted in front of the one receptacle for movement relative to the frame between first and second positions, wherein with the first support member in the first position, at least one of the first support member and an article in the display position on the first support member substantially blocks the one receptacle from view from a front display viewing vantage point, wherein with the first support member in the second position, the one receptacle is at least partially exposed so that an article in the one receptacle is accessible to be removed from the one receptacle wherein the first support member does not extend into the one receptacle as the first support member moves between the first and second positions from the front of the frame; and (B) a second module having the same construction as the first module wherein the first and second modules are releasably connected together to form a composite display system consisting of at least the first and second modules.

15. The display system of claim 14, wherein the first and second modules have cooperating press fit connections to define the composite display center.

16. The display system of claim 14 further comprising (a) a first type of article in the display position on the first and second support members and (b) samples of the first type of article in the first and second storage areas.

17. The display system of claim 16, wherein each of the first and second storage areas includes a plurality of vertically spaced shelves each defining at least one storage receptacle for articles.

18. The display system of claim 17, wherein each of the support members has a front surface and top and bottom edges, each repositionable between first and second positions with one support member associated with each shelf, and wherein an article in the display position is attached to the front surface of one support member.

19. The display system of claim 18, wherein each of the support members is pivotable about its top edge between the first and second positions, and wherein the bottom edge of one support member in the first position overlaps the top edge of an adjacent lower support member in the first position to thereby fully block access to the storage receptacle defined by the shelf associated with the one support member.

20. The display system of claim 19, further comprising:

a plurality of different color/texture carpet swatches each in a display position on one of the support members, wherein there is at least one removable carpet swatch sample having a first color/texture in one storage receptacle defined by one of the shelves and a carpet swatch sample having the first color/texture in a display position on the support member associated with the one shelf, and at least one removable carpet swatch sample having a second color/texture in another storage receptacle defined by another of the shelves and a carpet swatch sample having the second color/texture in a display position on the support member associated with the another shelf, whereby a user can pivot a selected support member to the second position and remove a carpet swatch of a selected color/texture from the storage receptacle defined by the shelf associated with the selected support member.

21. The combination of claim 19, further comprising:

a plurality of different color/texture carpet swatches each in a display position on one of the support members, wherein each of the shelves includes a plurality of regularly spaced vertical members dividing each of the storage receptacles into a plurality of sub-receptacles, and wherein there is at least one removable carpet swatch sample having a first color/texture in one of the sub-receptacles on a first shelf and a carpet swatch sample having the first color/texture in a display position associated with the one sub-receptacle on the support member associated with the first shelf, and at least one removable carpet swatch sample having a second color/texture in another of the sub-receptacles on the first shelf and a carpet swatch sample having the second color/texture in a display position associated with the another sub-receptacle on the support member associated with the first shelf, whereby a user can pivot the support member associated with the first shelf to the second position and remove a carpet swatch of either the first or second color/texture from the first shelf.

22. The combination of claim 21, wherein the display carpet swatches are adhesively attached to the front surfaces of the support members.

23. The combination of claim 21, wherein the display carpet swatches are disposed in cup-shaped receptacles formed in the front surfaces of the support members.

24. The display system of claim 20, further comprising a kiosk, said kiosk comprising a plurality of different texture/color carpet samples, and a source of information and ideas on carpet selection related to the carpet samples displayed and stored in the composite display center.

* * * * *